US005156086A

United States Patent [19]

Kiema et al.

[11] Patent Number: 5,156,086

[45] Date of Patent: Oct. 20, 1992

[54] METHOD OF CALENDERING A PAPER WEB

[75] Inventors: Timo Kiema, Järvenpää ; Karl Sipi, Espoo; Timo Viitanen, Jokela, all of Finland

[73] Assignee: Valmet Paper Machinery Inc., Helsinki, Finland

[21] Appl. No.: 748,238

[22] Filed: Aug. 21, 1991

Related U.S. Application Data

[63] Continuation of Ser. No. 435,333, Nov. 13, 1989, abandoned.

[30] Foreign Application Priority Data

Nov. 11, 1988 [FI] Finland ..... 885231
Nov. 1, 1989 [FI] Finland ..... 895179

[51] Int. Cl.[5] ..... B30B 15/34; D21G 1/00

[52] U.S. Cl. ..... 100/38; 100/93 RP; 162/206

[58] Field of Search ..... 100/35, 38, 93 RP, 155 R, 100/161, 176; 29/110, 132; 162/206, 207, 359; 427/130; 219/469, 244, 470, 471

[56] References Cited

U.S. PATENT DOCUMENTS

| | | | |
|---|---|---|---|
| 1,862,656 | 6/1932 | Boyer | 100/38 X |
| 3,185,816 | 5/1965 | Lusebrink | 219/469 X |
| 3,189,729 | 6/1965 | Lusebrink | 100/93 RP X |
| 3,190,212 | 6/1965 | Moore | 100/93 RP X |
| 3,201,558 | 8/1965 | Lusebrink | 219/469 X |
| 3,291,039 | 12/1966 | Christie | 29/132 X |
| 3,451,331 | 6/1969 | Fredrickson et al. | 100/93 RP |
| 3,720,808 | 3/1973 | Morrissey | 219/469 |
| 4,158,128 | 6/1979 | Evdokimov et al. | 219/469 |
| 4,606,264 | 8/1986 | Agronin et al. | 100/38 |
| 4,614,565 | 9/1986 | Riihinen | 100/93 RP X |
| 4,653,395 | 3/1987 | Verkasalo | 100/38 |
| 4,676,862 | 6/1987 | Kuehnert | 100/93 RP X |
| 4,738,197 | 4/1988 | Mälkiä | 100/38 |
| 4,757,582 | 7/1988 | Verkasalo | 100/38 X |

FOREIGN PATENT DOCUMENTS

| | | | |
|---|---|---|---|
| 60-111342 | 6/1985 | Japan | 100/93 RP |
| 441378 | 12/1974 | U.S.S.R. | 100/161 |

*Primary Examiner*—Harvey C. Hornsby
*Assistant Examiner*—Stephen F. Gerrity
*Attorney, Agent, or Firm*—Dellett, Smith-Hill and Bedell

[57] ABSTRACT

The invention concerns a method in calendering, wherein one or several pairs of rolls are employed through which the web to be calendered runs. One roll in each pair of rolls is a hard roll which is a heated metal roll, and the other roll in each pair of rolls is a roll provided with a resilient coating. In the method, the face of the roll with a resilient coating is also heated to a high temperature, advantageously to the same temperature as the heated metal roll. The invention also concerns a roll used in the method as well as the use of the method and of the roll.

3 Claims, 1 Drawing Sheet

METHOD OF CALENDERING A PAPER WEB

CROSS-REFERENCE TO RELATED APPLICATIONS

This is a continuation of copending Application Ser. No. 07/435,333 filed Nov. 13, 1989 and now abandoned.

BACKGROUND OF THE INVENTION

The invention concerns a method in calendering, wherein the web to be calendered runs through one or several pairs of rolls and one roll in each pair of rolls is a heated roll, and the other roll in each pair of rolls is a roll provided with a resilient coating.

The invention further concerns a roll for use in the method as well as the use of the method and of the roll.

In the crude state, the paper coming out of a paper machine has a rough face, which requires finishing for most purposes of use, said finishing resulting in smoothing and densification of the face. For the purpose of finishing, smoothing devices (e.g. machine calenders) and resilient-nip calenders (e.g. soft or supercalenders) are known. The smoothing devices comprise hard rolls only, and they even the boundary faces of the paper so that the parts that form the surface of the paper are substantially in one plane. The roll nips in a resilient-nip calender are so-called soft roll nips, i.e., nips in which a hard roll forms a pair of rolls with an elastically resilient roll. At present, the elastically resilient rolls in resilient-nip calenders are entirely predominantly paper rolls, i.e., rolls that consist of paper strips fitted as layers one above the other. To a certain extent, a calender also affects the smoothing, but in the first place, however, the glaze, i.e., the surface of the paper web is densified and closed.

The designations supercalendering and softcalendering used in the application are not official designations; instead of softcalendering some people speak of matte-calendering. A supercalender is an off-machine device, whereas a softcalender is either an on-machine (1 or 2 nips) or an off-machine (at least 4 nips) device. In softcalenders the resilient rolls are not paper rolls, which is the case in supercalenders, but they are different types of polymer or equivalent rolls, in which their own internal generation of heat is inferior to that taking place in paper rolls and in which the susceptibility of marking is lower. In its purest form softcalendering would be calendering that is carried out as on-line operation by making use of high temperatures (significantly higher than in a supercalendar) with a minimum number of nips. At present a softcalender is used extensively instead of a machine calendar with mat qualities as well as with coated papers in connection with a paper machine or coating machine when either the running speeds are low and/or the machines are narrow and/or the linear loads and/or the temperatures used are not among the highest. As a rule, high-glaze papers continue to be calendered by means of a supercalender.

A module calender refers to a calender which consists of one or several nips (i.e., modules) formed by a steel roll and a soft roll as described in the patent.

Most resilient-nip calenders are so-called supercalenders, which consist of a number of rolls fitted one above the other, said rolls being alternating soft and hard. In this ways the paper web runs through a number of roll nips, through one nip after the other. The hard rolls used in a typical supercalender are of metal, as a rule of steel and/or cast iron, and the soft rolls are paper- or cloth-filled.

The metal rolls in the pairs of rolls are usually heated so as to obtain good results.

The main problem associated with paper calendering has been the poor ability of the resilient rolls to endure high temperatures. Prior-art attempts to extend the service lives of resilient rolls involved cooling of the steel core of the roll by making its filler material of asbestos and cellulose and by using so-called heat-resistant fibers. For example, according to the U.S. Pat. No. 3,291,039, a resilient roll with superior resistance to heat was made of several sheets of cellulose fibers which had been treated with an additive so that they should endure highest temperatures and so that the coating consisted of several layers. According to the patent, this roll endures temperatures of 110°-140° C.

As prior art, reference is also made to the U.S. Pat. No. 3,451,331, wherein a calender is used that is provided with heated hard steel rolls, as well as to the Finnish patent application 864020.

In types of supercalendering mentioned above, at the side of the resilient roll the properties of the paper are developed more weakly than at the side of the steel roll. One reason is the different surface properties of the rolls, and the other reason is that the surface temperatures of the steel rolls are higher than those of the resilient rolls. When moving over to softcalendering, attempts are made to employ even higher temperatures, whereby the difference between the sides is increasing further. Thereat, in order to minimize unequal-sidedness, in softcalendering it is necessary to use an even number of nips, whereby both sides of the paper receive an equal number of steel-roll treatments, for without a resilient counter-roll it is impossible to calender a paper to high quality.

The difference in the calendering result given by a steel roll and by a resilient roll and the one-sidedness of the use of high temperatures (only at the side of the steel roll) constitute a problem both in supercalendering and in softcalendering.

Thus, in prior art, to solve this problem, in softcalendering an even number of nips was used, in which case both sides of the paper receive an equal number of treatments with a (hot) steel roll.

Since it has not been possible to make use of heat at more than one side of the paper per nip, this involves extra nips and a loss of bulk of the paper.

SUMMARY OF THE INVENTION

The object of the invention is to provide a calendering method and a roll for use in the method by means of which the problems discussed above are avoided.

Thus, the method in accordance with the invention is mainly characterized in that in the method one or both of the rolls in each pair of rolls is/are provided with a resilient coating which rolls or rolls is/are heated to a high temperature.

On the other hand, the roll for use in the method of the invention is mainly characterized in that the resilient roll coating that is used in one or both of the rolls in each pair is thermally conductive or contains thermally conductive material which can be heated to a high temperature.

The roll is not intended for use in softcalenders only, but also for use in supercalenders. Further possible applications include, e.g. the press section in a paper machine.

In the calendering method in accordance with the invention, the hard roll and the resilient roll or the two resilient rolls in each pair of rolls in a calender can be heated either traditionally from inside or both from inside and from outside, or from outside only. The two rolls may be heated in the same way or in different ways.

If the heating is applied to the roll face from outside only, the face or coating to be heated is insulated from inside in order that thermal energy should not be carried as lost heat into the interior portions of the roll. If internal heating is also employed, no insulating layer is needed.

If a traditional steel roll is used as a counter-roll, it is advisable to insulate its steel mantle from inside if, e.g. the inside heating (provided underneath the surface) is arranged by means of bores in the mantle or if no inside heating is employed, in order that the capacity of the external source of heat should not be carried into the interior portions of the steel roll as lost heat.

Heating can be carried out, e.g. externally by means of induction or by some other method by means of which heating of the coating or lining or of the thermally conductive material contained in the coating or lining is produced, e.g. by radiation or conduction. In addition to induction, such methods may include, e.g. a separate heatable steel roll which is in contact with the face of the coating or lining, or infrared, short-wave, or laser radiation, etc., or a traditional heating of the roll by means of oil or water circulating inside the roll, depending on the nature of the material to be heated. The heating systems may operate either alone or by means of various combinations, and they are interrelated with the magnitude of the heating capacity that is required by the calendering process.

As the coating of a steel roll, it is possible to use materials known in prior art.

The coating of a resilient roll consists of a binder coating and of a thermally conductive material and, as was explained above, of a possible insulation.

The binder coating may contain, e.g. some polymer resistant to high temperatures, such as polyimide, polyamide-imide, polyether-(ether)-ketone, etc., or some other material, e.g. a metallic-ceramic plastic composite for which optimized properties of resilience and hardness as well as mechanical and technical properties can be modified and which endures high temperatures and is suitable for the calendering process. The thermally conductive material may consist, e.g. of carbon or metal in particle, fibrous or film form, or of some other material, e.g. of a composite mixture, which has good properties of thermal conductivity and which can be combined with the binder agent. The insulation material may be, e.g. of the type of cellular plastic or some other material of high insulating capacity, e.g. of ceramic-composite type or, when the filled-roll technique is employed, the filler material itself forms the insulation.

The rolls are manufactured by means of prior-art methods.

The operation of the calendering employed in the invention takes place by means of the traditionally known roll technique of calendering, wherein a nip process is formed between two rolls through which the paper web runs. Thus, an essential difference compared to the prior-art method resides in that the resilient roll coating or lining is also heated in the process to a high surface temperature, advantageously to the same temperature as the face of the steel roll if the counter roll is a steel roll, i.e., as a rule, to about 200° C., but if necessary, it may be heated even up to about 300° C.

As a steel roll to be heated, it is possible to employ a traditional solution wherein the heating takes place from inside and, if necessary, from outside while the mantle is made of steel. Alternatively, in a steel roll to be heated, an insulation is employed, in which case the heating takes place from outside only while the mantle is made of steel. According to a further alternative, the mantle is made of an especially high-strength composite material and, at the same time, operates as an insulation, and the layer to be heated has optimized properties and the heating takes place from outside.

In a resilient roll to be heated in accordance with the invention, the thermally conductive coating can be heated from inside and from outside. According to an alternative, the coating to be heated is metallized, and the heating takes place from outside only, in which case there is a resilient thermally non-conductive insulation underneath the coating. Further alternatives include a resilient coating manufactured by means of the filled-roll technique (prior-art method) whose face is metallized, the heating taking place from outside.

A further alternative is a mantle exclusively composed of a composite material of especially high strength, the layer to be heated having optimized 1 properties of resilience and the heating taking place from outside. In a solution of prior art, a resilient coating or lining and a coating of sheet matrix pressed in the direction of the steel axle are employed.

One of the most advantageous embodiments of the present invention is a single-nip (e.g. module calender) calender, and the optimal solution is as follows, because in this solution it is possible to optimize the calendering process at both sides of the paper.

Steel roll:

e.g. ceramic-metallic composite of special hardness or plastic composite coating that has optimized hardness values (thermally conductive);

composite of special strength which is an insulation and a roll mantle at the same time;

the heating takes place by means of induction or by means of some other external source of heat mentioned above.

Resilient roll:

heatable coating with optimized properties of resilience;

composite of special strength which is an insulation and a roll mantle at the same time;

the heating takes place by means of induction or by means of some other external source of heat.

There may also be other popular embodiments, besides a single-nip calender, e.g. in an on-line process, one or more nips one after the other (two modules) when high-quality glazed paper is desired.

In the present invention, the calendering process can be optimized by, for each application, using the best combination which consists of a steel roll fitted against a heatable resilient roll. Thus, the alternatives of coating material and heating described above can be combined in any way whatsoever depending on the properties and objects of application that are desired.

BRIEF DESCRIPTION OF THE DRAWINGS

In the following, with reference to the figures, examples will be given on preferred exemplifying embodiments, the invention being not supposed to be confined to said embodiments alone.

In the drawings.

DETAILED DESCRIPTION

Figure 1:
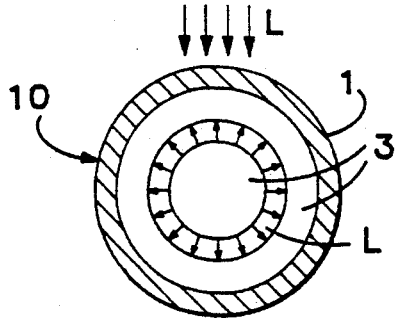
FIG. 1 is a sectional view illustrating the structure of a first resilient roll.

FIG. 1 is a sectional view of a first resilient roll 10 in accordance with the invention, wherein the heating L takes place both from inside and from outside and wherein the coating 1 consists of metal particles dispersed in a binder agent. This is a homogeneous metal-polymer mixture, whereby the coating is throughout thermally conductive. Since the heating takes place both from inside and from outside, no insulation is required. The mantle 3 is made of steel.

Figure 2:
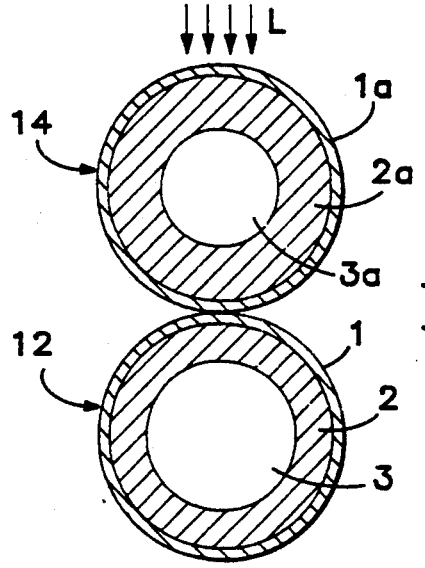
FIG. 2 is a sectional view illustrating the structure of a second resilient roll and also illustrates the structure of a heating roll.

FIG. 2 is a sectional view of a second resilient roll 12 in accordance with the invention whose heating takes place exclusively from outside by means of another roll 14, which has a metal coating 1*a*, an insulation material 2*a*, and a steel mantle 3*a*. In FIG. 2, the heatable resilient roll 12 in accordance with the invention comprises a metal coating 1 which encloses a filler material operating as an insulation 2, said figure also showing the steel axle 3 of the roll.

Figure 3:
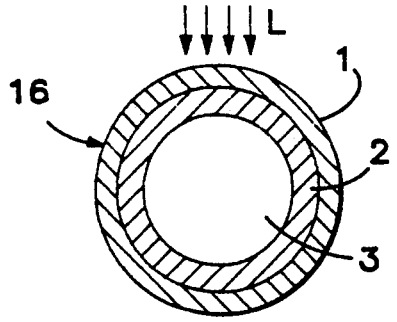
FIG. 3 is a sectional view illustrating the structure of a third resilient roll.

FIG. 3 is a sectional view of a third resilient roll 16 in accordance with the invention whose heating takes place from outside alone. The roll has a thermally conductive coating 1, an insulation layer 2 placed underneath, and a steel mantle 3 placed underneath said insulation layer.

Figure 4:
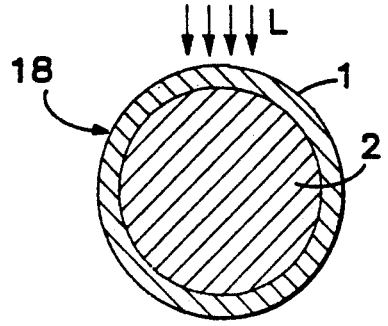
FIG. 4 is a sectional view illustrating the structure of a fourth resilient roll.

FIG. 4 is a sectional view of a fourth resilient roll 18 in accordance with the invention, which comprises a thermally conductive coating 1 and, underneath said coating, a composite mantle 2 of special strength, which also operates as insulation. The heating takes place from outside.

In the following, the patent claims will be given, whereat the various details of the invention may show variation within the scope of the inventive idea defined in said claims.

We claim:

1. A method of calendering a paper web, comprising running the web through at least one nip defined between a web contact surface of a first roll and a web contact surface of a second roll, said first roll having a roll body, a resilient coating, and insulating material between the roll body and the resilient coating and said second roll either having a resilient coating or being a hard roll, and utilizing an external source to supply thermal energy to each roll so that the web contact surfaces are heated to a high temperature, wherein the external surface is used to supply thermal energy to the coating of the first roll from the exterior of the first roll.

2. A method of calendering a paper web, comprising running the web through at least one nip defined between a web contact surface of a first roll and a web contact surface of a second roll, said first roll having a resilient coating and a mantle that is made of composite material and inside which there is insulation material and said second roll either having a resilient coating or being a hard roll, and utilizing an external source to supply thermal energy to each roll so that the web contact surfaces are located to a high temperature, wherein the external source is used to supply thermal energy to the web contact surface of the first roll from the exterior of the first roll.

3. A method according to claim 2, wherein the insulation material is a composite material.

* * * * *